United States Patent [19]

Matsumoto et al.

[11] 4,245,486

[45] Jan. 20, 1981

[54] RETRACTABLE CHARM DEVICE

[75] Inventors: Hajime Matsumoto, Nagareyama; Yoichi Abe, Ohyama-Hishimachi, both of Japan

[73] Assignee: Toybox Corporation, Japan

[21] Appl. No.: 35,830

[22] Filed: May 4, 1979

[30] Foreign Application Priority Data

Dec. 21, 1978 [JP] Japan ..... 53-177240[U]

[51] Int. Cl.[3] ..... A63H 11/04

[52] U.S. Cl. ..... 63/23; 46/132; 63/31; 428/28

[58] Field of Search ..... 40/2 A; 46/32, 132; 63/1 R, 2, 31; 428/3, 16, 28

[56] References Cited

U.S. PATENT DOCUMENTS

| | | | |
|---|---|---|---|
| 545,958 | 9/1895 | Hoffmann | 46/132 |
| 2,812,601 | 11/1957 | Hines | 40/2 A |
| 3,122,900 | 3/1964 | Beghetto, Jr. | 428/28 X |
| 3,328,910 | 7/1967 | Hughes | 46/132 |
| 3,481,155 | 12/1969 | Cook | 428/28 X |
| 3,526,103 | 9/1970 | Lieber | 428/16 X |
| 4,056,896 | 11/1977 | Karasawa | 46/132 |
| 4,068,401 | 1/1978 | Saitoh | 46/119 X |

*Primary Examiner*—Henry F. Epstein
*Attorney, Agent, or Firm*—Staas & Halsey

[57] ABSTRACT

A retractable charm device having a two part body formed in a desired shape, movable appendages extending from the body, mechanical mechanism mounted within the body, the mechanical mechanism including two support panels attached to each other, a plurality of gears rotatably mounted between the two support panels on axles, a cam affixed to one of said gears for actuating the movable appendages through cam follower structure, a take-up spool affixed for rotation with one of the gears, an energization cord attached to the take-up spool, a spring fixed at one end to one gear and at the other end to an element of one panel, a guided element for the energization cord mounted on one panel, and structure attached to the other end of the energization cord for permitting a pull to be exerted on the cord to unwind same from the take-up spool and thus, in turn, energize the spring for later actuation of the mechanical mechanism and the movable appendages.

8 Claims, 9 Drawing Figures

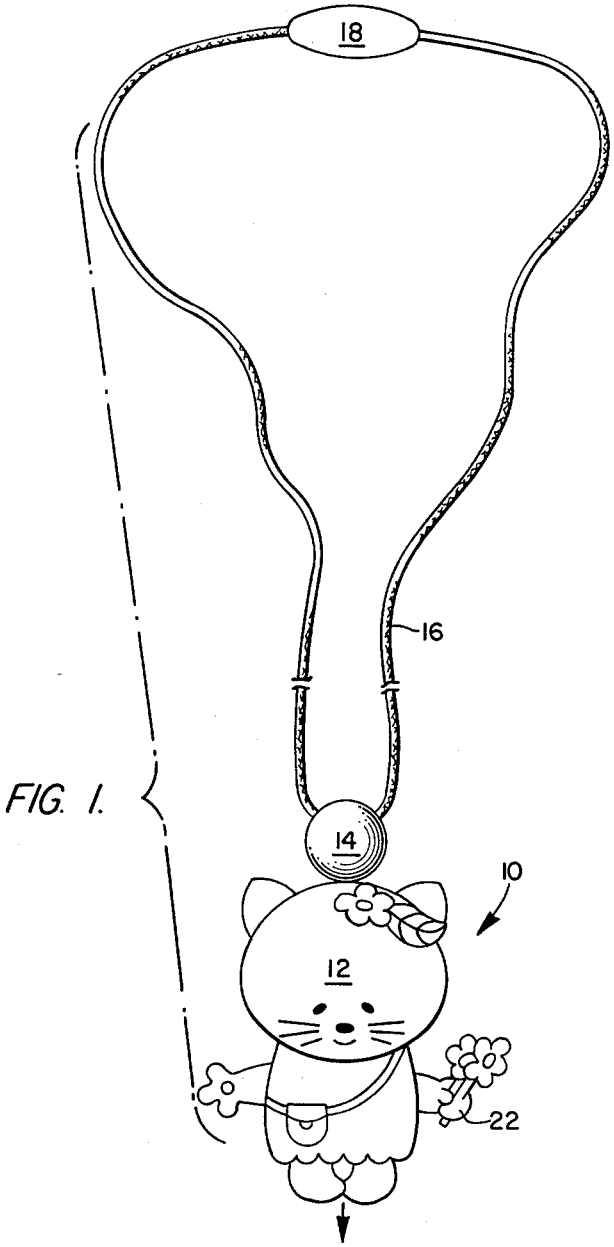
FIG. 1.
FIG. 2.
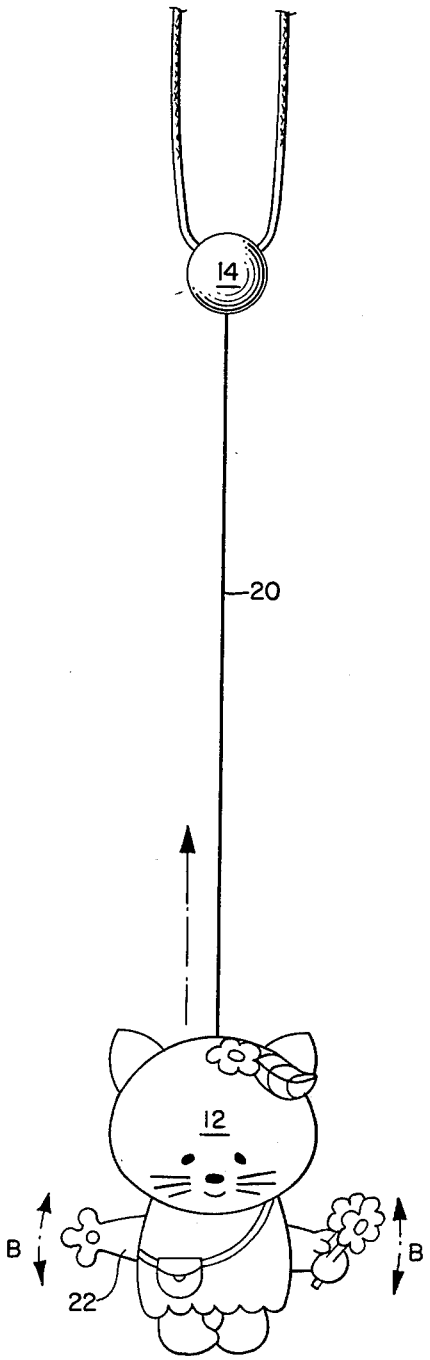
FIG. 3.
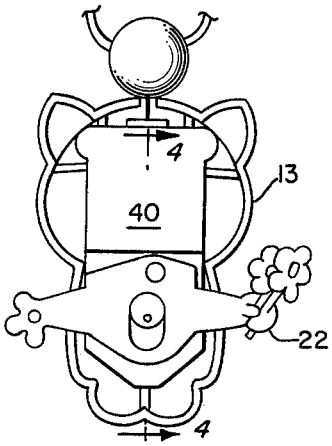

FIG. 4.
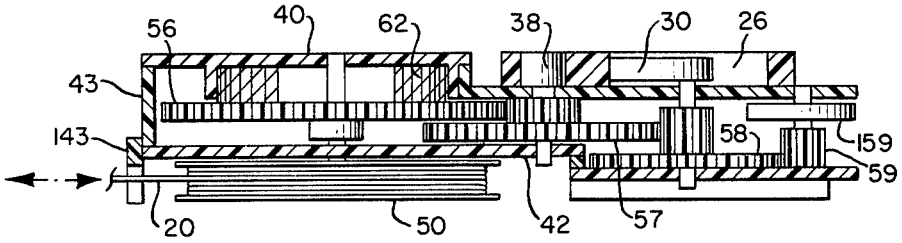
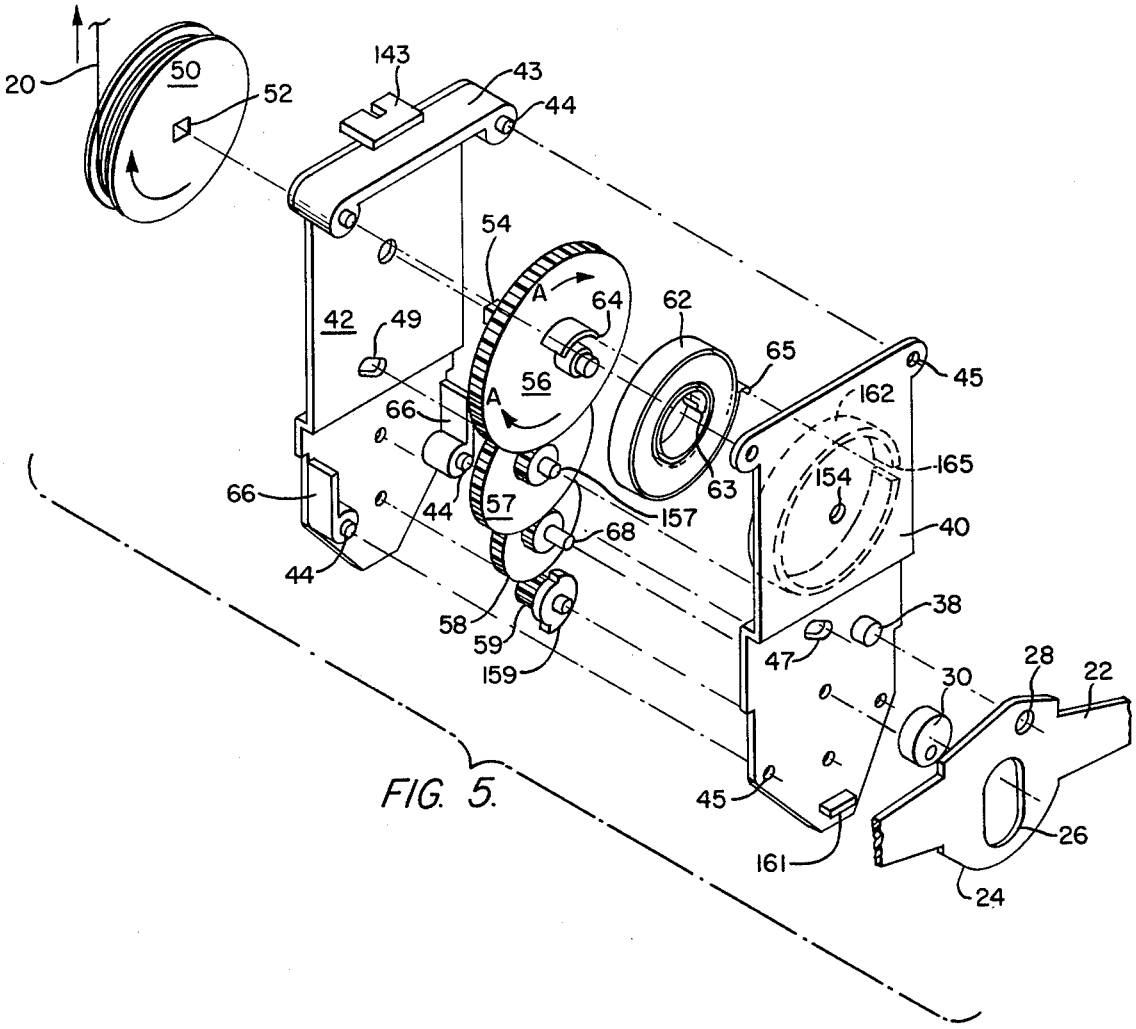
FIG. 5.

RETRACTABLE CHARM DEVICE

BACKGROUND OF THE INVENTION

Field of the Invention

This invention relates to retractable charm devices which are attractive in appearance, have movable animated action, and also are functional in use.

SUMMARY OF THE INVENTION

An object of the present invention is to provide a charm device which is attractive, animated, and self-energizing, as well as useful.

Another object is to provide a pendant device together with a necklace having a pull cord connected thereto which energizes a spring motor within the pendant for self-retraction of the cord once the pendant is released. Movable appendages are provided to create attention getting movement.

A further object is to provide a charm device for the purpose of holding keys which will permit the keys to be extended away from the device for convenient use thereof, and then will self-retract the keys back to the charm device upon release thereof.

These together with other objects and advantages which will become subsequently apparent reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

FIG. 1 is a front elevational view of the charm device with the energization cord retracted therewithin;

FIG. 2 is a front elevational view with the energization cord extended;

FIG. 3 is a front elevational view of the device of FIG. 1 with the front cover plate removed;

FIG. 4 is a side elevational view, partly in cross-section, taken generally along line 4—4 of FIG. 3;

FIG. 5 is an exploded perspective view of the internal components of the device;

DESCRIPTION OF THE PREFERRED EMBODIMENT

Figure 6:
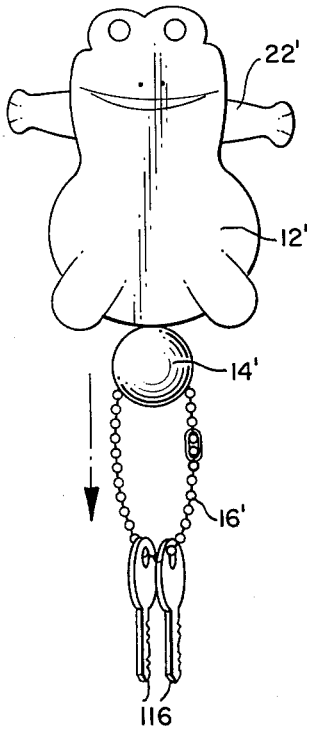
FIG. 6 is a front elevational view of another embodiment of the device for use as a key holder.

Looking at FIG. 1 of the drawing, reference numeral 10 indicates in general the pendant embodiment of this invention. The device has a body consisting of a removable front cover plate 12 and a main housing 13. The body, in the shape of a small figure or animal, is supported by an energization cord 20 connected to a linking sphere 14. Also connected to the linking sphere 14 is a necklace or neck cord 16 having an ornamental bead or connector 18 approximately midway between the portion which is held by sphere 14.

Movable arms or appendages 22 are mounted on the body 12, 13 for movement under actuation of the mechanical mechanism therewithin. The device is arranged so that when a wearer of the necklace 16 with the pendant suspended therefrom, desires to attract attention, the pendant can be withdrawn away from the sphere 14, thus extending the support and energization cord 20. When this occurs an internal spring is wound up which when the pendant is released effects self-retraction thereof by taking up the extended cord 20. Simultaneously with the above, the movable appendages 22 are actuated through a gear train and cam mechanism to effect attention getting movement BB thereof.

Looking at FIGS. 4 and 5 of the drawings, the internal mechanism of the body can be seen. A chassis having a first support panel 40 and a second support panel 42 supports the operating mechanism for the charm. The second panel 42 has side ribs 66 and end rib 43 attached thereto with projecting guide pins 44. The guide pins 44 mate with apertures 45 at the corners of the first panel 40. A primary gear 56 is affixed to axle 54. One end of axle 54 is square shaped for mating with the square aperture 52 of the take-up spool 50. The other end of the axle is round for pivotal support in the aperture 154 in panel 40. Attached to gear 56 is a spring engaging end clip 64. This clip engages with end 63 of the spring 62 and the other end 65 of this spring fits into slot 165 within the raised annular guard 162 on the inner side of panel 40. Thus, spring 62 is supported for winding and unwinding, and yet still constrained from unwinding past a desired point.

Gear 56 in turn drives combination pinion and gear 57 and 58 for finally driving a counterbalance pinion 59 having a counterbalance weight 159 affixed thereto. The first pinion and gear 57 has an axle 157, the ends of which are supported in angular slots 47 and 49 in the respective panels 40 and 42. The purpose of these angular slots is to permit the drive from gear 56 through the train of gears in only one direction. That is, when the charm is pulled away from the wearer, thus rotating gear 56 in the direction of arrows AA, the spring 62 will be wound up to the fully energized position, and simultaneously gear 56 will drive gear and pinion 57 in the direction to move same along slots 47, 49 to disengage some from pinion and gear 58. Thus the drive to the gears past 57 is effectively disconnected. Thus when the pendant is pulled down to extend energization cord 20, the drive train for the movable appendages 22 will be disconnected. Thus, these appendages will not be actuated when the spring 62 is being energized.

Then, when the charm device is released the spring 62 will rotate gear 56 and spool 50 to take up the support cord 20 back onto the spool 50. However, in this direction of rotation, which is opposite to the arrows AA shown on gear 56 in FIG. 5, the gear and pinion 57 will move about gear 56, as constrained within slanted slots 47, 49, to reengage the drive from pinion and gear 57 to pinion and gear 58 and thus actuate the rest of the mechanism.

Pinion and gear 58 is fastened onto axle 68 with the end of the portion of axle 68 which passes through panel 40 having fixed thereto a cam 30. The cam 30 mates with the elongated aperture 26 within the central structure 24 supporting the appendages 22. A pivot aperture 28 supports the central structure 24 on pivot pin 38 extending from panel 40. Thus, when the cam 30 is rotated, due to the eccentric positioning thereof, the appendage structure 22, 24 will be made to move about pivot support 28, 38 to effect an up and down movement BB of the appendages 22 as indicated in FIG. 2. The counterweight 159 and pinion 59 effectively balance the offset weight of eccentrically mounted cam 30. Guide 143 mounted on end rib 43 of panel 42, in association with a slot provided in housing 13 (not shown), guides the cord 20 in the proper path as spool 50 is wound and unwound.

Thus, as one can easily visualize, this charm device when used as a pendant and worn about a person's neck, will provide an attractive and animated charm for creating pleasure and enjoyment.

Figure 7:
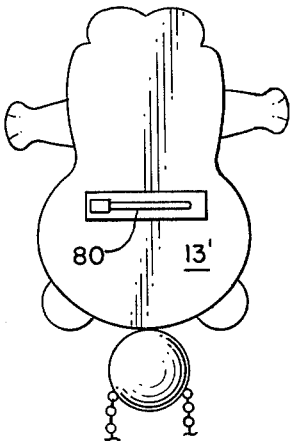
FIG. 7 is a back elevational view of the device of FIG. 6.
Figure 8:
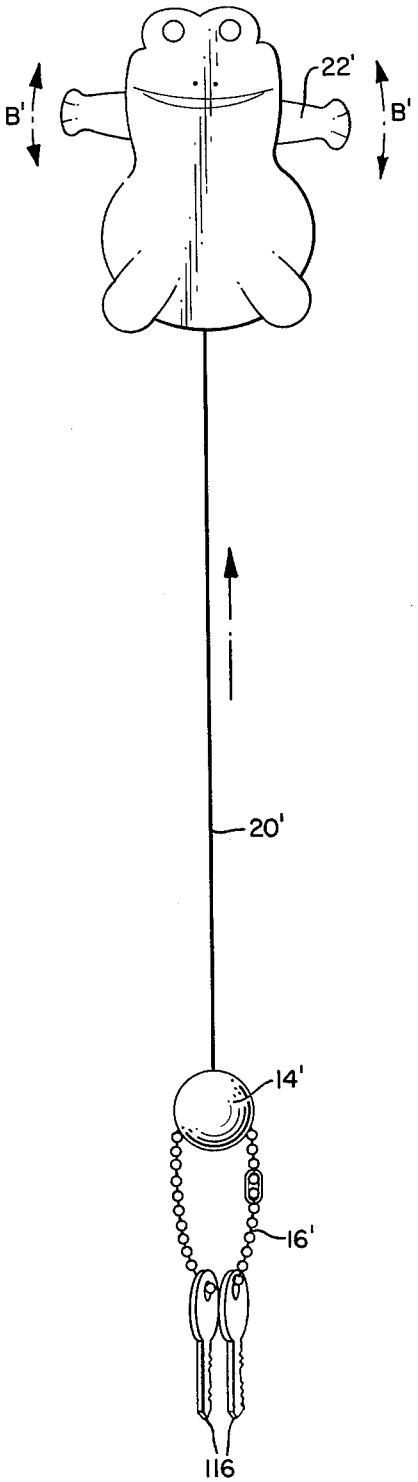
FIG. 8 is another front elevational view showing the energization cord and key chain support of the keyholder extended for use.

A further even more functional embodiment is shown in FIGS. 6–8 of the drawings. In this embodiment, the charm device is used as a holder for keys. Instead of a neck cord the sphere 14' supports the ends of a key holding chain 16' so that a plurality of keys 116 may be held by the device.

The two-part body 12', 13' of the charm may be in the shape of another figure, or may be in the shape of an amphibian such as the frog shown. On the back of the device, as shown in FIG. 7, a safety pin type clip 80 is affixed. This clip 80 may be used to attach the charm device to the user's clothes. The key holder then can be in a readily usable position. Thus, when it is desired to use a key the cord 20' can be extended as shown in FIG. 8 to a position allowing for use of a key or keys. Again, upon the release of the cord 20', the movable appendages 22' will be appropriately actuated through cam mechanism within the device similar to the cam mechanism already described. Thus, the charm device of this invention can be quite useful as a retractable key holder.

Figure 9:
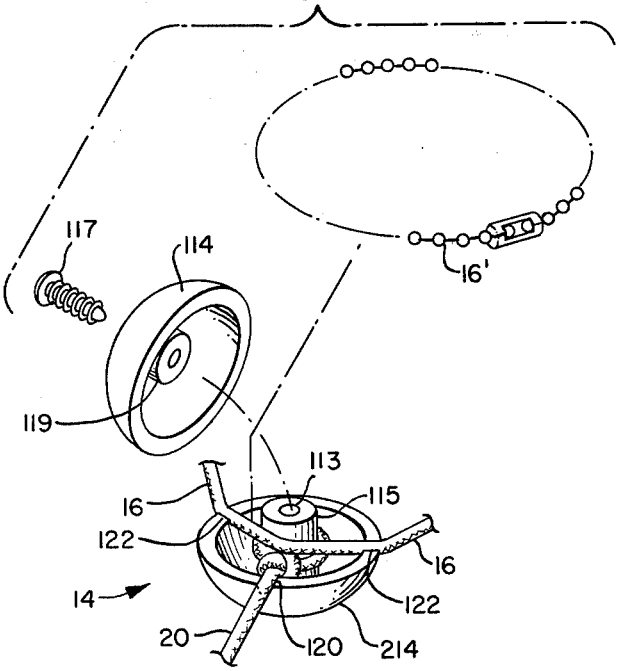
FIG. 9 is an exploded perspective view of the linking sphere usable with both embodiments.

FIG. 9 shows the linking sphere 14 taken apart. The energization cord 20 is tied to inner support post 115 and led to the outside of the sphere through recess 120. A portion of the neck cord 16 passes around post 115 and through recesses 116. When the cap portion 114 is secured to the lower portion 214 by the large headed screw 117 passing through aperture 119 and screwed into the center aperture 113 of the post 115, the neck cord 16 and energization cord 20 are positively retained with sphere 14. However, because of the disassemblable construction of sphere 14, a keychain 16' can be quickly and easily substituted for the neck cord 16, either by the original manufacturer, or by an end user of the charm device.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

We claim:

1. A retractable charm device comprising: a body, movable appendages extending from said body, mechanical mechanism contained within said body for effecting movement of said appendages, an energization cord which can be withdrawn from said body to effect operation of said mechanical mechanism, said mechanical mechanism including a spring which is wound up when the energization cord is withdrawn from said body, additional mechanism including a take up spool for effecting take up of said cord when it is released relative to the body, said mechanical mechanism including a one-way drive arrangement for permitting disengagement of parts of said mechanism from the rest thereof during energizing of the spring of the device whereby when the cord is being withdrawn from said body disengagement of the one-way drive arrangement will permit the spring to be wound up without operation of the rest of the mechanism and yet will permit driving of the rest of the mechanism when the cord is released and the spring provides the drive for the operation of the device, and said one-way drive arrangement comprising a plurality of gears, at least one pinion and gear mounted upon an axle, the ends of said axle supported in angular slots in each of a pair of support panels mounted in said body to function as the one-way drive arrangement.

2. The retractable charm device as in claim 1, wherein said body is in the shape of an animal figure, and the movable appendages depict forearms of the figure.

3. The retractable charm device as in claim 2, wherein the energization cord is connected to a small sphere, and the small sphere holds a portion of a neck cord so the device may be used as a pendant.

4. The retractable charm device as in claim 1, wherein said body is in the shape of an amphibian, and the movable appendages depict forelegs of the amphibian.

5. The retractable charm device as in claim 4, wherein the energization cord is connected to a small sphere, and the sphere holds a portion of a key chain so that the device may be used as a key holder.

6. The retractable charm device as in claim 1, wherein the energization cord is connected to a small disassemblable sphere, said sphere including two separable parts with one part having an inner support post for fastening one end of the energization cord thereto and also for permitting fastening of the other half of the sphere thereto, and the combined parts of the sphere holds a portion of an interchangeable element so that the device may be used in several useful manners.

7. The retractable charm device as in claim 6, wherein said body is in the shape of a figure, and the movable appendages depict the arms of the figure.

8. A novelty device comprising:

a two-part body member formed with a desired shape, movable appendages extending from said body member, mechanical mechanism mounted within said body member, said mechanical mechanism including two support panels attached to each other, a plurality of gears rotatably mounted between said two support panels on axles, a cam affixed to one of said gears for actuating the movable appendages through cam follower structure, a take up spool affixed for rotation with one of said gears, an energization cord attached to the take up spool, a spring fixed at one end to said one gear and at the other end to an element of one panel, a guide element for said cord mounted on one panel, and means attached to the other end of said energization cord for permitting a pull to be exerted on said cord to unwind same from the take up spool and thus in turn energize the spring for later actuation of said mechanical mechanism and the movable appendages, and said plurality of gears including a pinion and gear mounted upon an axle, the ends of said axle being supported in angular slots provided in said support panels to permit a one-way drive arrangement whereby when said energization cord attached to said take up spool is withdrawn from the device the spring will be energized without actuation of the cam and movable appendages and yet upon release of the energization cord will permit the spring to effect engagement of the one-way drive arrangement and thus operate through the plurality of gears, the cam and movable appendages.

* * * * *